US005641817A

United States Patent [19]

Aghajanian et al.

[11] Patent Number: 5,641,817

[45] Date of Patent: Jun. 24, 1997

[54] METHODS FOR FABRICATING SHAPES BY USE OF ORGANOMETALLIC, CERAMIC PRECURSOR BINDERS

[75] Inventors: Michael Kevork Aghajanian; Jonathan Wayne Hinton, both of Newark; Alexander Lukacs, III, Wilmington; James Allen Jensen, Hockessin; Marc Stevens Newkirk, Newark, all of Del.; Ratnesh Kumar Dwivedi, Thornton, Pa.

[73] Assignee: Lanxide Technology Company, LP, Newark, Del.

[21] Appl. No.: 482,698

[22] Filed: Jun. 7, 1995

Related U.S. Application Data

[63] Continuation-in-part of Ser. No. 121,814, Sep. 15, 1993, Pat. No. 5,433,261, which is a continuation-in-part of Ser. No. 55,654, Apr. 30, 1993, abandoned.

[51] Int. Cl.[6] ..... B22D 19/14

[52] U.S. Cl. ..... 523/141; 523/149; 164/97; 164/100; 164/461; 428/550

[58] Field of Search ..... 523/141, 149, 523/492, 440, 449, 442; 164/47, 461, 97, 100; 501/94; 264/63

[56] References Cited

U.S. PATENT DOCUMENTS

| | | | |
|---|---|---|---|
| 2,492,763 | 12/1949 | Pinkney | 260/144 |
| 2,515,628 | 7/1950 | Castle | 260/192 |
| 2,970,982 | 2/1961 | Bluestein | 260/46.5 |
| 3,093,494 | 6/1963 | Hedlund et al. | 106/38.2 |
| 3,432,312 | 3/1969 | Feagin et al. | 106/38.3 |
| 3,898,090 | 8/1975 | Clark | 106/38.2 |
| 4,076,685 | 2/1978 | Kogler | 260/42.53 |
| 4,357,165 | 11/1982 | Helferich et al. | 106/38.3 |
| 4,526,219 | 7/1985 | Dunnavant et al. | 164/16 |
| 4,602,069 | 7/1986 | Dunnavant et al. | 525/504 |
| 4,775,704 | 10/1988 | Nagahori et al. | 523/143 |
| 4,894,254 | 1/1990 | Nakayama et al. | 427/38 |
| 4,929,704 | 5/1990 | Schwark | 528/28 |
| 4,942,145 | 7/1990 | Moehle et al. | 501/90 |
| 5,021,533 | 6/1991 | Schwark | 528/21 |
| 5,138,014 | 8/1992 | Katano et al. | 528/29 |
| 5,167,271 | 12/1992 | Lange et al. | 164/98 |
| 5,183,096 | 2/1993 | Cook | 164/98 |
| 5,190,709 | 3/1993 | Lukacs, III | 264/93 |
| 5,249,621 | 10/1993 | Aghajanian et al. | 164/97 |

FOREIGN PATENT DOCUMENTS

| | | |
|---|---|---|
| 0255441 | 2/1988 | European Pat. Off. . |
| 1365207 | 5/1964 | France . |
| 3119062 | 9/1989 | Japan . |
| 5024939 | 2/1993 | Japan . |
| 790685 | 2/1958 | United Kingdom . |
| 2040295 | 8/1980 | United Kingdom . |
| 2114140 | 8/1983 | United Kingdom . |

*Primary Examiner*—Tae Yoon
*Attorney, Agent, or Firm*—Kevin J. Boland

[57] ABSTRACT

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches and liners, etc.). In a preferred embodiment, this invention relates to thermosettable, liquid ceramic precursors which provide suitable-strength sand molds and sand cores at very low binder levels and which, upon exposure to molten metalcasting exhibit low emissions toxicity as a result of their high char yields of ceramic upon exposure to heat. Another preferred embodiment of the invention involves the fabrication of preforms used in the formation of composite articles.

32 Claims, 1 Drawing Sheet

METHODS FOR FABRICATING SHAPES BY USE OF ORGANOMETALLIC, CERAMIC PRECURSOR BINDERS

This application is a continuation-in-part of U.S. patent application Ser. No. 08/121,814, filed Sep. 15, 1993, now U.S. Pat. No. 5,433,261, which in turn is a continuation-in-part of U.S. patent application Ser. No. 08/055,654, filed on Apr. 30, 1993, now abandoned.

FIELD OF THE INVENTION

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches and liners, etc.) as well as utilizing ceramic precursor binders to make porous preforms and subsequently filling at least a portion of the porous preform with a second material to form a composite body. In a preferred embodiment, this invention relates to thermosettable, liquid ceramic precursors which provide suitable-strength sand molds and sand cores at very low binder levels and which, upon exposure to molten metal-casting exhibit low emissions toxicity as a result of their high char yields of ceramic upon exposure to heat. In another preferred embodiment, this invention involves thermosettable, liquid ceramic precursors in the formation of a permeable mass of filler material and the fabrication of preforms used in the formation of composite articles.

BACKGROUND OF THE INVENTION

The casting of metal articles using sand molds, sand shells and sand cores is well known in the art. Detailed information regarding the state of this technology can be found, for example, in a text by James P. LaRue, EdD, *Basic Metal-casting* (The American Foundrymen's Society, Inc., Des Plaines, Ill., 1989). Using such a technique, a mold can be made from a mixture of sand and (typically) an organic binder by packing the mixture loosely or tightly around a pattern. The pattern is then removed, leaving a cavity in the sand which replicates the shape of the pattern. Once the organic binder is shape-stabilized by any of a number of hardening techniques (as described below), the cavities in the sand mold are filled with molten metal by pouring the molten metal into the mold.

Many traditional shaping techniques exist for forming loose masses of particulate, fibers, whiskers, etc., into a desired shape followed by some set of processing conditions which typically involve high temperature exposures. For example, many traditional ceramic processing techniques such as slip casting, dry pressing, isostatic pressing, hot pressing, extrusion, etc., each involves the consolidation of an initial loose mass or unbonded array of constituents into a shaped member having at least some structural integrity. Moreover, in each of these techniques some means for initially holding the loose mass together until the loose mass can itself consolidate into a preferred shape is necessary. Common to many of the traditional approaches is the use of a binder system which imparts at least some initial "green" strength to the body to permit the body to hold its predetermined shape.

Further, common to each of the aforementioned traditional techniques is the application of thermal energy. A primary purpose of the application of thermal energy is to permit individual constituents of the green body to begin to, for example, sinter together to form a more rigid body. Typically, when such sintering occurs, a part will change in size and/or shape due to porosity in the green body being consolidated. It is during such sintering operations that cracking, bending, and/or uncontrolled shrinking may occur. The art is replete with many techniques for controlling undesirable aspects associated with traditional sintering processes.

The art also includes processing techniques for the formation of composite bodies. For example, rather than starting with any of the constituents discussed above and causing such constituents to consolidate into a dense, shaped body, the art teaches that porosity in a first material can be filled with a second material to form a desirable composite body. For example, the porosity in a first formed body could be filled with an inorganic material such as a ceramic or a glass, a polymer, a metal or alloy, an intermetallic and the like. The impetus for forming a composite body is to achieve a synergistic interaction between the constituents of the composite. Specifically, a single material by itself may not be able to withstand certain corrosive and/or erosive environments and/or certain high temperature environments, etc. However, by combining two or more materials together, desirable attributes of both materials may be utilized to overcome the shortcomings of a single material.

A key element for reliably and economically producing desirable composite materials involves the ability to produce economically and reliably a shaped first material into which a second material can be introduced. Many techniques exist for shaping a porous first material into an acceptable body for introduction of a second material or matrix therein; however, the search continues for better techniques to form porous first materials. This invention attempts to satisfy the need for achieving a reliably and economically produced first material which reliably and economically accepts a second material to result in a desirable composite body.

Binders used for the preparation of preforms for use in the fabrication of metal matrix and ceramic matrix composites are typically wholly organic, or wholly inorganic compositions. Organic binder systems which may perform well under certain processing conditions may otherwise suffer certain disadvantages. For instance, in the fabrication of aluminum oxide matrix, ceramic matrix composites or aluminum matrix, metal matrix composites it is preferable to have a minimum carbon residue in the finished composite. Thus, it is essential that organic binders used in the formation of preforms are substantially completely burned out prior to infiltration of the metal matrix or growth of the ceramic matrix. The resulting preform is often weak and requires careful handling prior to the matrix introduction. When wholly inorganic binders are incorporated in the fabrication of preforms, undesirable inorganic phases may result within the final composition, such as, for example, silicon dioxide, which can lower the thermal performance of these composites.

Organometallic, ceramic precursors are known in the art of ceramic processing. These materials can be in the form of either solvent-soluble solids, meltable solids, or hardenable liquids, all of which permit the processibility of their organic counterparts in the fabrication of ceramic "green bodies". During the sintering of such green parts, however, the ceramic precursor binders have the added advantage of contributing to the overall ceramic content of the finished part, because the thermal decomposition of such ceramic precursor binders results in relatively high yields of ceramic "char". Thus, most of the precursor is retained in the finished part as ceramic material, and very little mass is evolved as undesirable volatiles. This second feature is advantageous, for example, in reducing part shrinkage and the amount of voids present in the fired part, thereby reducing the number of critically sized flaws which have been shown to result in strength degradation of formed bodies.

Such precursors can be monomeric, oligomeric, or polymeric and can be characterized generally by their processing flexibility and high char yields of ceramic material upon thermal decomposition (i.e. pyrolysis). These precursors are neither wholly inorganic nor wholly organic materials, since they comprise metal-carbon bonds. These precursors can be distinguished from other known inorganic binders for sand mold fabrication described above (which comprise no carbon), and other known organic binders (which comprise no metallic elements). It has been unexpectedly discovered that such organometallic "hybrids" which are hardenable liquids are uniquely suited for use as binders for sand grains in the fabrication of sand molds, cores, and shells, since they can provide excellent mold strength at extremely low binder levels. Their utility resides in a unique combination of, for example, the processing flexibility afforded by organic binders and the high char forming characteristics and improved adhesion to sand of inorganic binders. Such binders can therefore be easily processed to provide a hardened sand mold, and subsequently used for metalcasting with a minimum of toxic volatiles being evolved.

Further, it has been unexpectedly discovered that such organometallic "hybrids" are uniquely suited for use as binders for filler materials in the fabrication of preforms to be used in the formation of composite materials. For example, such organometallic "hybrids" have been found to be uniquely suited to the formation of metal matrix composites by molten metal infiltration processes (e.g., spontaneous infiltration, pressure and vacuum assisted infiltration, etc.). Moreover, these organometallic "hybrids" have also been found to be useful as preform binders for ceramic matrix composite formation processes (e.g., directed metal oxidation, sintering, isostatic pressing, chemical vapor infiltration, etc.). Additionally, organometallic "hybrids" have also been found to be useful as preform binders for polymer matrix composite formulation processes. Further, since such organometallic, ceramic precursor binders are also liquids, they can be employed directly without use of a solvent. This obviates the emissions and disposal problems associated with solvent-based systems which require a "drying" step subsequent to mold shaping. Further, traditional binder materials "burn-out" when heated, yielding performs with little or inadequate strength. Conversely, the binders of the present invention "burn-in", that is, the binders of the present invention may be converted in high yield to a ceramic when heated, thus yielding preforms with excellent strength for subsequent composite formation processes.

Siloxanes have been used in the past to improve the adhesion of such binder systems as polycyanoacrylates to sand grains (see, for example, U.S. Pat. No. 4,076,685). In such a system the siloxane is used as a processing aid rather than the binder itself. Additionally, partial condensates of trisilanols have been used in combination with silica as binder systems which are provided in aliphatic alcohol-water cosolvent (see, for example, U.S. Pat. No. 3,898,090). Such in-solvent binders have been shown to suffer the disadvantage of short shelf life ("several days") due to additional silanol condensation during storage. A further disadvantage is that these binders require the step of solvent removal from the core or mold by a drying process ("to remove a major portion of the alcohol-water cosolvent") before metalcasting. Otherwise, voids and poor mold integrity result during the metalcasting process. The use of hardenable, liquid organometallic, ceramic precursors as solventless binders for the fabrication of sand molds, shells, cores, and binders for preforms has not been disclosed.

SUMMARY OF THE INVENTION

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches, liners, and preforms of various components for further processing, etc.). Moreover, the invention relates to utilizing organometallic ceramic precursors as binders for filler materials in the fabrication of preforms to be used in the formation of composite materials.

A preferred embodiment of the invention relates to the fabrication of shaped metal, or metal matrix composite, articles by metalcasting into sand molds, shells or sand cores prepared using hardenable, liquid, organometallic, ceramic precursor binders. In this preferred embodiment, the method comprises (1) solventless coating of the surface of sand with a hardenable, liquid, organometallic, ceramic precursor binder, (2) forming a shape from said sand/binder mixture, (3) hardening said binder to form a sand mold, shell, or core, and (4) metalcasting into the resulting hardened sand mold, shell, or core to form a shaped metal article.

It has been discovered that such solventless binder compositions can be used at very low binder levels since such binders can be made to be liquids which may provide for excellent sand grain surface wetting. Surprisingly, binder levels as low as 0.1 wt % of a polyureasilazane comprising crosslinkable vinyl groups result in sand molds which have excellent strength in metalcasting operations.

In a typical process according to a preferred embodiment of the invention, a predetermined quantity of sand is coated by mixing the sand with an organometallic, ceramic precursor binder in an amount sufficient to result in a hardened sand mold, shell, or core having suitable strength for ease of handling, as well as sufficient structural integrity needed for the metalcasting process. However, the aforementioned sufficient strength should not be too great so as to deleteriously impact the ability to remove a cast metal part from a sand mold (e.g., by physically breaking the sand mold away from the cast part).

The sand/binder mixture is then shaped using standard procedures for preparing metalcasting molds, shells, or cores and then hardened using a procedure suited to the exact chemical composition of the organometallic, ceramic precursor binder.

The hardened mold, shell, or core is then used to pour a shaped metal object by a metalcasting process. It should be understood that while this disclosure refers primarily to a metalcasting process, the concepts of this disclosure also apply to the casting of metal matrix composite articles.

Another preferred embodiment of the invention relates to the use of organometallic ceramic precursor binders in the fabrication of preforms used in the formation of composite articles, such as ceramic composite articles and metal matrix composite articles.

In a first particularly preferred embodiment for forming metal matrix composite bodies, such organometallic ceramic precursor binders may be used to form preforms to be used in the fabrication of metal matrix composite articles by a pressureless metal infiltration process described, for example, in commonly owned U.S. Pat. No. 5,249,621, which issued Oct. 5, 1993, in the names of Aghajanian et al. and entitled "Method of Forming Metal Matrix Composite Bodies by a Spontaneous Infiltration Process and Products Produced Therefrom". The entire subject matter of the above-identified patent is herein expressly incorporated by reference. In this preferred embodiment, the method comprises (1) providing a solventless coating of a hardenable liquid, organometallic, ceramic precursor binder, on at least a portion of the surface of a filler material (2) optionally incorporating an infiltration enhancer and/or an infiltration enhancer precursor with the solventless coated filler material, (3) forming a shape from the filler material/binder mixture, optionally containing an infiltration enhancer precursor and/or an infiltration enhancer, (4) hardening said binder to form a permeable preform, and (5) spontaneously infiltrating the resulting permeable preform using the methods described in commonly owned U.S. Pat. No. 5,249,621 to form a shaped metal article.

In a second particularly preferred embodiment for forming ceramic composite bodies, such organometallic ceramic precursor binders may be used to form preforms to be used in the fabrication of ceramic matrix composite articles by "growing" a polycrystalline oxidation reaction product by reacting a parent metal with a suitable oxidant.

For example, a method for producing ceramic composite bodies having a predetermined geometry or shape is disclosed in Commonly Owned U.S. Pat. No. 5,017,526 which issued May 21, 1991. In accordance with the method in this U.S. Patent, the developing oxidation reaction product infiltrates a permeable preform of filler material in a direction towards a defined surface boundary. It was discovered that high fidelity is more readily achieved by providing the preform with a barrier means, as disclosed in Commonly Owned U.S. Pat. No. 4,923,832, which issued May 8, 1990, in the names of Marc S. Newkirk et al. This method produces shaped self-supporting ceramic bodies, including shaped ceramic composites, by growing the oxidation reaction product of a parent metal to a barrier means spaced from the metal for establishing a boundary or surface.

Ceramic composites having a cavity with an interior geometry inversely replicating the shape of a positive mold or pattern are disclosed in Commonly Owned U.S. Pat. No. 5,051,382, issued Sep. 24, 1991.

A method for tailoring the constituency of the metallic component of a ceramic matrix composite structure is disclosed in Commonly Owned U.S. Pat. No. 5,017,533, which issued on May 21, 1991, in the names of Marc S. Newkirk et al., and entitled "Method for In Situ Tailoring the Metallic Component of Ceramic Articles and Articles Made Thereby".

Moreover, U.S. Pat. No. 4,818,734, which issued Apr. 4, 1989, in the names of Robert C. Kantner et al. discloses methods for tailoring the constituency of the metallic component (both isolated and interconnected) of ceramic and ceramic matrix composite bodies during formation thereof to impart one or more desirable characteristics to the resulting body. Thus, desired performance characteristics for the ceramic or ceramic composite body are advantageously achieved by incorporating the desired metallic component in situ, rather than from an extrinsic source, or by post-forming techniques.

As discussed in these Commonly Owned Ceramic Matrix Patents, novel polycrystalline ceramic materials or polycrystalline ceramic composite materials are produced by the oxidation reaction between a parent metal and an oxidant (e.g., a solid, liquid and/or a gas). In accordance with the generic process disclosed in these Commonly Owned Ceramic Matrix Patents, a parent metal (e.g., aluminum) is heated to an elevated temperature above its melting point but below the melting point of the oxidation reaction product to form a body of molten parent metal which reacts upon contact with an oxidant to form the oxidation reaction product. At this temperature, the oxidation reaction product, or at least a portion thereof, is in contact with and extends between the body of molten parent metal and the oxidant, and molten metal is drawn or transported through the formed oxidation reaction product and towards the oxidant. The transported molten metal forms additional fresh oxidation reaction product in contact with the oxidant, at the surface of previously formed oxidation reaction product. As the process continues, additional metal is transported through this formation of polycrystalline oxidation reaction product thereby continually "growing" a ceramic structure of interconnected crystallites. The resulting ceramic body may contain metallic constituents, such as non-oxidized constituents of the parent metal, and/or voids. Oxidation is used in its broad sense in all of the Commonly Owned Ceramic Matrix Patents and in this application, and refers to the loss or sharing of electrons by a metal to an oxidant which may be one or more elements and/or compounds. Accordingly, elements other than oxygen may serve as an oxidant.

In certain cases, the parent metal may require the presence of one or more dopants in order to influence favorably or to facilitate growth of the oxidation reaction product. Such dopants may at least partially alloy with the parent metal at some point during or prior to growth of the oxidation reaction product. For example, in the case of aluminum as the parent metal and air as the oxidant, dopants such as magnesium and silicon, to name but two of a larger class of dopant materials, can be alloyed with aluminum, and the created growth alloy is utilized as the parent metal. The resulting oxidation reaction product of such a growth alloy, in the case of using oxygen as an oxidant, comprises alumina, typically alpha-alumina.

Novel ceramic composite structures and methods of making the same are also disclosed and claimed in certain of the aforesaid Commonly Owned Ceramic Matrix Patents which utilize the oxidation reaction to produce ceramic composite structures comprising a substantially inert filler (note: in some cases it may be desirable to use a reactive filler, e.g., a filler which is at least partially reactive with the advancing oxidation reaction product and/or parent metal) infiltrated by the polycrystalline ceramic matrix. A parent metal is positioned adjacent to a mass of permeable filler (or a preform) which can be shaped and treated to be self-supporting, and is then heated to form a body of molten parent metal which is reacted with an oxidant, as described above, to form an oxidation reaction product. As the oxidation reaction product grows and infiltrates the adjacent filler material, molten parent metal is drawn through previously formed oxidation reaction product within the mass of filler and reacts with the oxidant to form additional fresh oxidation reaction product at the surface of the previously formed oxidation reaction product, as described above. The resulting growth of oxidation reaction product infiltrates or embeds the filler and results in the formation of a ceramic composite structure of a polycrystalline ceramic matrix embedding the filler. As also discussed above, the filler (or preform) may utilize a barrier means to establish a boundary or surface for the ceramic composite structure.

Thus, the aforesaid Commonly Owned Ceramic Matrix Patents describe the production of polycrystalline oxidation reaction products which are readily grown to desired sizes and thicknesses heretofore believed to be difficult, if not impossible, to achieve with conventional ceramic processing techniques. The subject matter of each of the above-discussed Commonly Owned Ceramic Matrix Patents is hereby incorporated by reference.

In any case, it has been discovered that the solventless binder compositions of the instant invention can be used at very low levels since such binders can be made to be liquids which may provide for excellent filler material surface wetting. In one embodiment of the present invention, when forming metal matrix composite bodies by a spontaneous infiltrating technique, when an infiltration enhancer or an infiltration enhancer precursor is used in combination with the filler material, binder levels from about 0.5 weight percent to about 3 weight percent of a polyureasilazane may be used. Surprisingly, binder levels as low as 0.1 weight percent of a polyureasilazane comprising crosslinkable vinyl groups result in preforms which have excellent strength for use in composite formation processes. Further, it has been unexpectedly discovered that preforms made from such binder compositions and which have excellent strength can be formed by low pressure pressing in which the pressing strength applied may be preferably, from about 20 to about 500 psi and even more preferably from about 20 to about 100 psi.

In a typical process according to a preferred embodiment of the invention, a predetermined quantity of filler material is coated by contacting the filler material with an organometallic, ceramic precursor binder, such as by mixing, spraying, dipping, or the like, in an amount sufficient to result in a hardened preform having suitable strength for ease of handling, as well as sufficient structural integrity needed for a subsequent composite formation process.

The hardened preform is then used in the composite formation process to form a metal matrix composite article or a ceramic matrix composite article. It should be understood that while the present disclosure refers primarily to forming metal matrix composite bodies by the pressureless metal infiltration process, the concept of this disclosure also applies to formation of metal matrix composite articles by, for example, pressure infiltration, vacuum-assisted infiltration, etc.

In addition, the present invention may also be utilized in the fabrication of other composite bodies, such as polymer matrix composites, glass matrix composites and the like.

DETAILED DESCRIPTION OF THE INVENTION

Figure 1:
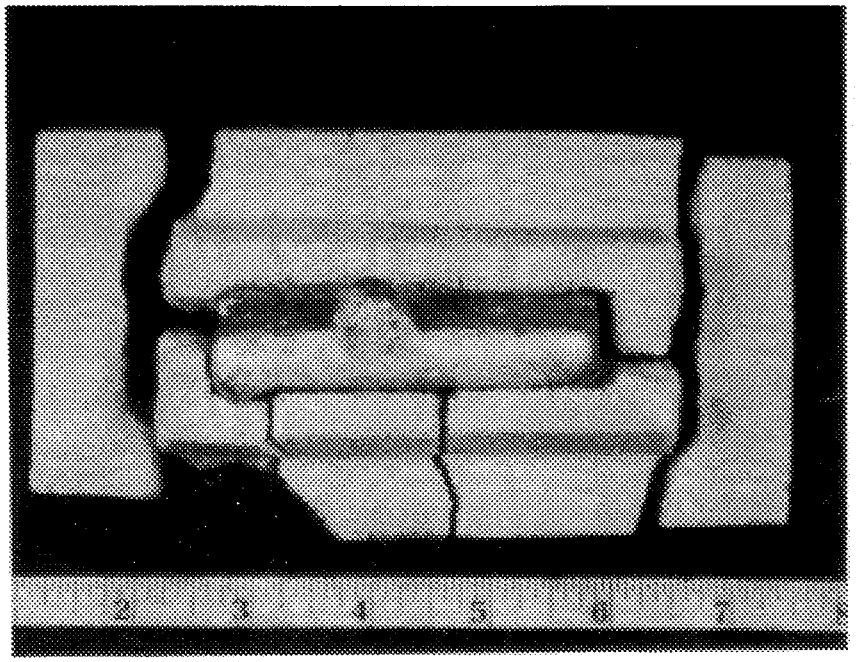
FIG. 1 is a photograph of the cast aluminum alloy piece and the sand mold formed in Example 5.

This invention relates to the discovery of organometallic ceramic precursor binders used to fabricate shaped bodies by different techniques. Exemplary shape making techniques which utilize hardenable, liquid, organometallic, ceramic precursor binders include the fabrication of negatives of parts to be made (e.g., sand molds and sand cores for metalcasting, etc.), as well as utilizing ceramic precursor binders to make shapes directly (e.g., brake shoes, brake pads, clutch parts, grinding wheels, polymer concrete, refractory patches, liners, and preforms for various components for further processing, etc.). It has now been discovered that certain organometallic binders provide enhanced binding capability for porous, particulate objects, and further contribute to the composition of the final composite, resulting in compositions which demonstrate superior performance relative to composites fabricated without the use of such binders.

The organometallic, ceramic precursor binders suitable for the practice of this invention include monomers, oligomers and polymers. The term "organometallic" should be understood as meaning a composition comprising a metal-carbon bond. Suitable metals include both main group and transition metals selected from the group consisting of metals and metalloids selected from IUPAC groups 1 through 15 of the periodic table of elements inclusive. Preferred metals/metalloids include titanium, zirconium, silicon and aluminum, with silicon being a preferred selection. Further preferred organometallic compositions comprising a metal-carbon bond further comprise a metal-nitrogen bond. Even further preferred organometallic compositions comprising metal-carbon and metal-nitrogen bonds suitable for the practice of this invention have metal-nitrogen bonds which may include silicon-nitrogen, aluminum-nitrogen and boron-nitrogen.

While monomeric ceramic precursors can satisfy the requirements necessary for the practice of this invention, monomers that polymerize to form hard polymers of appreciable ceramic yield (e.g., greater than 20 percent by weight) often have so low a molecular weight that volatilization at modest molding temperatures becomes a problem. One example of this is vinyltrimethylsilane, which has a boiling point of only 55° C. Curing this monomer by thermal or radical means to form a hardened binder requires temperatures greater than the boiling point of the monomer. It is thus unsuitable in the process described. Because monomers are generally too volatile to be used in this molding process, the preferred liquid ceramic precursors of this invention are either oligomeric or polymeric. An oligomer is defined as a polymer molecule consisting of only a few monomer repeat units (e.g., greater than two and generally less than 30) while a polymer has monomer repeat units in excess of 30. Suitable polymers include, for example, but should not be construed as being limited to polysilazanes, polyureasilazanes, polythioureasilazanes, polycarbosilanes, polysilanes, polysiloxanes, polyborosilazanes, polyaminosilazanes, polyaminoboranes, polyalazanes, and polyborazanes. Precursors to oxide ceramics such as aluminum oxide as well as non-oxide ceramics can also be used. Organometallic, ceramic precursors suitable for the practice of this invention should have char yields in excess of 20 percent by weight, preferably in excess of 40 percent by weight, and more preferably in excess of 50 percent by weight when the hardened precursor is thermally decomposed.

In a preferred embodiment of the present invention, the organometallic compositions comprise polymers containing metal-carbon bonds and which further comprise metal-nitrogen bonds. The preferred organometallic polymers suitable for the present invention include silicon-nitrogen polymers, aluminum-nitrogen polymers, and boron-nitrogen polymers comprising a multiplicity of sequentially bonded repeat units of the form (a), (b), (c), and (d), recited below:

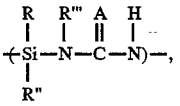

(a)

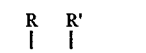

(b)

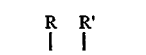

(c)

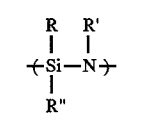

(d)

where R, R', R", and R'"=hydrogen, alkyl, alkenyl, alkynyl, or aryl, and A=O or S, are preferred.

The organometallic, ceramic precursors suitable for the practice of this invention preferably contain sites of organounsaturation such as alkenyl, alkynyl, epoxy, acrylate or methacrylate groups. In a preferred embodiment, the sites of organounsaturation may comprise alkenyl or alkynyl groups. In a further preferred embodiment of the present invention, the organometallic composition comprises a liquid polymer. In an even further preferred embodiment the liquid organometallic polymer comprises a metal-nitrogen polymer comprising the repeat units (a) or (b), wherein R=vinyl. In an even more preferred embodiment the liquid metal-nitrogen polymer comprises the repeat units (a), wherein R=vinyl, and R'=hydrogen. In a preferred embodiment where the organometallic composition is a liquid polymer, low molecular weight, liquid polymers are preferred for their ability to readily coat inorganic, particulate material used for the composite formation. In a further preferred embodiment, the liquid polymer is a metal-nitrogen polymer having an average molecular weight (Mn) of less than 2,000, and even more preferably less than 1,500, and most preferably less than 1,000.

Compositions comprising sites of organounsaturation may be cross-linked in a subsequent step by supplying an energy input in the form of, for example, thermal energy or radiation, such as ultraviolet radiation, microwave radiation or electron beam radiation, or laser energy, to promote a free radical or ionic crosslinking mechanism or the organounsaturated groups. Crosslinking reactions promote rapid hardening and result in hardened binders having higher ceramic yields upon pyrolysis. High ceramic yield typically results in lower volatiles evolution during metalcasting. Specific examples of such precursors include poly(acryloxypropylmethyl)siloxane, glycidoxypropylmethyldimethylsiloxane copolymer, polyvinylmethylsiloxane, poly(methylvinyl)silazane, 1,2,5-trimethyl-1,3,5-trivinyltrisilazane, 1,3,5,7-tetramethyl-1,3,5,7-tetravinyltetrasilazane, 1,3,5-tetravinyltetramethylcyclotetrasiloxane, tris(vinyldimethylsiloxy)methylsilane, and trivinylmethylsilane.

When heat is provided as the source of energy, a free radical generator, such as a peroxide or azo compound, may, optionally, be added to promote rapid hardening at a low temperature. Exemplary peroxides for use in the present invention include, for example, diaroyl peroxides such as dibenzoyl peroxide, di p-chlorobenzoyl peroxide, and bis-2,4-dichlorobenzoyl peroxide; dialkyl peroxides such as 2,5-dimethyl-2,5-di(t-butylperoxy)hexane and di t-butyl peroxide; diaralkyl peroxides such as dicumyl peroxide; alkyl aralkyl peroxides such as t-butyl cumyl peroxide and 1,4-bis(t-butylperoxyisopropyl)benzene; alkylaroyl peroxides and alkylacyl peroxides such as t-butyl perbenzoate, t-butyl peracetate, and t-butyl peroctoate. It is also possible to use peroxysiloxanes as described, for example, in U.S. Pat. No. 2,970,982 (the subject matter of which is herein incorporated by reference) and peroxycarbonates such as t-butylperoxy isopropyl carbonate.

Symmetrical or unsymmetrical azo compounds, such as the following, may be used as free radical generators: 2,2'-azobis(2-methylpropionitrile); 2,2'-azobis(2,4-dimethyl-4-methoxyvaleronitrile); 1-cyano-1-(t-butylazo)cyclohexane; and 2-(t-butylazo)isobutyronitrile. These products are well known and are described, for example, in U.S. Pat. Nos. 2,492,763 and 2,515,628 (the subject matter of which is herein incorporated by reference).

In addition to crosslinking which may be provided through sites of organounsaturation which are appended to the organometallic, ceramic precursor binder, additional modes of crosslinking provided by polymer chain condensation upon pyrolysis may be beneficial. Thus, for example, silicon polymers comprising nitrogen are preferred to silicon polymers comprising oxygen, since nitrogen is trivalent. In polysilazanes, for instance, the repeat unit of the polymer chain contains Si—N bonds in which the nitrogen atom is then further bonded both to either two addition silicon atoms, or a silicon atom and a carbon or hydrogen atom. Upon thermal treatment, such polysilazanes crosslink via N—C or N—H bond cleavage with subsequent crosslinking provided by formation of an additional Si—N bond. Such crosslinking provides for higher char yields upon binder hardening. This leads to lower volatiles evolution during metalcasting when such polymers are used as binders for the sand mold, shells, or cores which are used.

Any known methods of coating the sand with the liquid, organometallic, ceramic precursor can be used. Such methods comprise, but are not limited to simple hand mixing, mulling, milling, etc.

In the formation of molds for casting, the amount of organometallic, ceramic precursor binder used in coating should be such that the strength of the hardened, molded sand object is sufficient to provide for easy handling and also sufficient to ensure structural integrity of the mold during the metalcasting process. Similarly, the amount of organometallic, ceramic precursor binder utilized in the formation of preforms for composite article fabrication should allow for ease of handling and sufficient structural integrity during the composite formation process. Surprisingly, when suitable organometallic ceramic precursors are used such binder levels can be quite low. While binder levels can be in the range of 0.1% to about 20% based on the total weight of the sand/binder mixture or the filler material/binder mixture, preferably 0.1 wt % to 5 wt %, and more preferably 0.1 wt % to 2 wt % of binder should be used. When highly crosslinkable organometallic, ceramic precursor binders are used, the lowest levels of binder can be achieved.

While not wishing to be bound by any particular theory or explanation, it is believed that the unique suitability of such organic/inorganic "hybrid" systems derives from their ability to provide the processing flexibility and hardened strength of organic resin binders with the sand surface-compatibility of inorganic binder systems. Such sand surface-compatibility is described in, for example, U.S. Pat. No. 4,076,685 (the subject matter of which is herein incorporated by reference), wherein a siloxane is used to promote adhesion of a thermoplastic cyanoacrylate polymer binder to sand grains.

Once formulated, the sand/binder mixture can be formed into molds, shells, cores or preforms by any technique known in the art. Binder hardening is then accomplished by vapor arc, heat arc, chemical cure and/or combinations thereof.

In a preferred embodiment, where the organometallic ceramic precursor binder comprises a site of organounsaturation such as a vinyl group which can be crosslinked by thermal treatment to harden the binder, a free radical initiator can be added to the composition to facilitate the free radical crosslinking of the binder which serves to irreversibly harden the composition. When a free radical generator is used, a temperature is generally selected so that the hardening time is greater or equal to one or preferably two half lives of the initiator at that temperature. It is important for the sand/binder mixture to harden sufficiently so that ease of handling and metalcasting can be ensured. Likewise, it is important that the filler material/binder mixture hardens sufficiently so that ease of handling the preform in preparing for and during composite formation can be insured. Suitable free radical initiators include, but are not limited to, organic peroxides, inorganic peroxides, and azo compounds.

Once the binder is hardened, the sand molds, shells, and cores can then be used for metalcasting. Typical metals suitable for such application include aluminum, aluminum alloys, iron, ferrous alloys and composites including such metals as the matrix.

Another preferred embodiment of the invention relates to the use of organometallic ceramic precursor binders in the fabrication of preforms used in the formation of composite articles. Such preforms are used in the formation of, for example, polymer matrix composites, ceramic matrix composites, and particularly metal matrix composites. Metal matrix composite articles made by the pressureless metal infiltration process are described in, for example, commonly owned U.S. Pat. No. 5,249,621, which issued Oct. 5, 1993, in the names of Aghajanian et al. and entitled "Method of Forming Metal Matrix Composite Bodies by a Spontaneous Infiltration Process and Products Produced Therefrom". The entire subject matter of the above-identified patent is herein expressly incorporated by reference.

Moreover, as discussed above herein, in a particularly preferred embodiment for forming ceramic composite bodies, such organometallic ceramic precursor binders may be used to form preforms to be used in the fabrication of ceramic matrix composite articles by "growing" a polycrystalline oxidation reaction product by reacting a parent metal with a suitable oxidant.

The permeable preform of this invention may be created or formed into any predetermined or desired size and shape by any conventional method, such as slipcasting, injection molding, transfer molding, vacuum forming, or otherwise, by processing any suitable material(s), which will be more specifically identified and described hereafter. The preform should be manufactured with at least one surface boundary, and should retain sufficient shape integrity and green strength to provide dimensional fidelity prior to being infiltrated by the metal matrix or ceramic matrix. The permeable preform, however, may be permeable enough to accommodate infiltration of molten metal or growing polycrystalline matrix. Preferably, the preforms of this invention have a porosity of between about 5 and 90% by volume, and more preferably between about 25 and 50%. The porous preform preferably should be capable of being wetted by the molten metal under process temperature conditions in order to encourage infiltration of molten metal within the preform to produce a composite product of high integrity and well-defined borders.

The preform, may be any size or shape, and has at least one surface boundary which essentially defines the destination or boundary for the infiltrating metal or growing polycrystalline matrix. A matrix of material is infiltrated into the permeable preform so as to infiltrate and embed the constituents of the latter to its defined surface boundary without substantially disturbing or displacing it. Thus, no external forces are involved which might damage the preform, little or no shrinkage is involved which might crack the preform and cause it to lose fidelity with respect to its original shape and tolerance, and no awkward and costly high temperature, high pressure processes and facilities are required to achieve a composite product. In addition, the special requirements of chemical and physical compatibility necessary for pressureless sintering of particulate composites are avoided by the present invention.

The permeable preform of this invention may be composed of any suitable material, such as ceramic and/or metal particulates, powders, fibers, whiskers, wires, particles, hollow bodies or spheres, wire or refractory cloth, solid spheres, etc., and combinations thereof. The preform materials may comprise a bonded array or arrangement comprising interstices. The preform may include a lattice of reinforcing rods, bars, tubes, tubules, plates, wires, spheres or other particulates, platelets, wire cloth, ceramic refractory cloth or the like, or a combination of any of the foregoing, prearranged in a desired shape. Further, the material(s) of the preform may be homogeneous or heterogeneous.

More specifically, with respect to suitable materials that may be employed in the formation and manufacture of the permeable preform, three classes of materials may be identified as suitable materials for the permeable preform.

The first class of preform materials includes those chemical species which, under the temperature and reaction conditions of the process used, are not volatile, are thermodynamically stable and do not react with or dissolve excessively in the matrix composition. For example, in the formation of metal matrix composites and ceramic matrix composites, numerous materials are known to those skilled in the art as meeting such criteria in the case where aluminum is the matrix or parent metal. Such materials include, for example, metal oxides of aluminum, cerium, hafnium, lanthanum, yttrium, and zirconium. In addition, a large number of binary, ternary, and higher order metallic compounds such as magnesium aluminate spinel, $MgOAl_2O_3$, are contained in this class of stable refractory compounds.

A second class of suitable materials for the preform are those which are not intrinsically stable in the high temperature and reaction environment, but which, due to the relatively slow kinetics of the degradation reactions, can act and/or perform as the preform phase when infiltrated by the matrix. A particularly useful material for this invention is silicon carbide.

A third class of suitable materials for the preform of this invention are those which are not, on thermodynamic or on kinetic grounds, expected to survive the reaction environment or the exposure to the matrix composition necessary for the practice of the invention. Such a preform can be made compatible with the process of the present invention if the environment is made less active, for example, through the use of $H_2/H_2O$ or $CO/CO_2$ mixtures as the oxidizing gas in the formation of ceramic matrix composites, or through the application of a coating thereto, such as aluminum oxide, which makes the species kinetically non-reactive in the process environment. An example of such a class of preform materials for example, in the formation of ceramic matrix composite articles, would be carbon fiber employed in conjunction with a molten aluminum parent metal. These unwanted reactions may be avoided by coating the carbon fiber (for example, with alumina) to prevent reaction with the parent metal and/or oxidant and optionally employing a $CO/CO_2$ atmosphere as oxidant which tends to be oxidizing to the aluminum but not the contained carbon fiber.

The particulate filler may be molded by known or conventional techniques such as, for example, by forming a combination comprising a particulate filler and a metal-carbon binder composition, pouring the filler and binder combination into a mold, and then letting the part set, for example, by hardening the binder.

The preform of this invention may be employed as a single preform or as an assemblage of preforms to form more complex shapes. It has been discovered that the matrix can infiltrate through adjacent, contacting portions of a preform assemblage, and bond contiguous preforms at their contact surfaces into a unified or integral ceramic composite. The assembly of preforms is arranged so that the direction of the infiltration will be towards and into the assembly of preforms to infiltrate and embed the assembly to the boundaries defined by the assembled preforms. Thus, complex composites can be formed as an integral body which cannot otherwise be produced by conventional manufacturing techniques. It should be understood that whenever the term "preform" is used herein and in the claims, it means a single preform or an assemblage of preforms, unless otherwise stated.

In producing a net or near net shape composite body which retains essentially the original shape and dimensions of the preform, infiltration of the matrix should occur to the at least one defined surface boundary of the preform. Infiltration which passes beyond the surface boundaries can be prevented, inhibited or controlled for example, in the formation of ceramic matrix composites, by incorporating solid or liquid oxidants in the preform such that internal growth is highly preferred to growth beyond the preform surfaces; controlling or limiting the amount of matrix composition available to the process; providing a barrier means on the preform surface(s) as described in Commonly Owned U.S. Pat. No. 5,340,655, which issued on Aug. 23, 1994, in the names of Creber et al., and entitled "Method of Making Shaped Ceramic Composites with use of a Barrier and Articles Produced Thereby", the subject matter of which is hereby incorporated by reference; or at the appropriate time, stopping the process, for example, in the formation of ceramic matrix composite bodies, by evacuating, or eliminating, the oxidizing atmosphere or by altering the reaction temperature to be outside the process temperature envelope, e.g., lowered below the melting point of the parent metal.

In a preferred embodiment, the method for forming a metal matrix composite comprises (1) providing a solventless coating on the surface of a filler material with a hardenable liquid, organometallic, ceramic precursor binder, (2) optionally incorporating an infiltration enhancer and/or an infiltration enhancer precursor with the solventless coated filler material, (3) forming a shape from the filler material/binder mixture, (4) hardening said binder to form a preform, and (5) spontaneously infiltrating the resulting preform using the methods described in U.S. Pat. No. 5,249,621 to form a shaped metal matrix article. In a further preferred embodiment, for example, where the organometallic binders comprises metal-nitrogen bonds, the spontaneous infiltration may occur below the temperatures generally preferred for spontaneous infiltration systems.

In an even further preferred embodiment, in the formation of a metal matrix composite, such as an aluminum matrix by a spontaneous infiltration system comprising aluminum matrix metal and a metal-nitrogen binder, the infiltrating atmosphere may comprise a non-nitrogen atmosphere. Although not wishing to be bound by any particular theory, it is believed that where the organometallic binders is a metal-nitrogen polymer, the metal-nitrogen polymer may provide a nitrogen source, for example, ammonia upon heating which is available to react with the infiltration enhancer precursor, for example, magnesium, to form an infiltration enhancer such as magnesium nitride, thus obviating the need for a nitrogen atmosphere.

It has been discovered that the solventless binder compositions of the instant invention can be used at very low levels since such binders are generally liquids or fusible compositions and therefore, provide for excellent filler material surface wetting. Surprisingly, binder levels as low as 0.1 weight percent of a polyureasilazane comprising crosslinkable vinyl groups result in preforms which have excellent strength for use in composite formation processes. Further, when forming metal matrix composites by a spontaneous infiltration technique and when an infiltration enhancer or an infiltration enhancer precursor is used in combination with the filler material, binder levels from about 0.5 weight percent to about 3 weight percent of a polyureasilazane may be used.

Moreover, a further advantage afforded by the present invention is the discovery that preforms made from such binder compositions have excellent strength and can be formed by low pressure pressing in which the pressing strength applied may be, preferably, from about 20 to about 500 psi, and even more preferably from about 20 to about 100 psi. Surprisingly, green preforms formed at such low pressure pressing have excellent strength, which leads to, among other things, ease of handling, ease of machining, and the ability to make complex shaped preforms.

Further, traditional binder materials "burn-out" when heated, yielding preform with low or inadequate strength. Conversely, the binders of the present invention "burn-in", that is, the binders of the present invention may be converted in high yield to a ceramic when heated, thus yielding preforms with excellent strength for subsequent composite formation processes.

In a typical process according to a preferred embodiment of the invention, a predetermined quantity of filler material is coated by mixing the filler material with an organometallic, ceramic precursor binder in an amount sufficient to result in a hardened preform having suitable strength for ease of handling, as well as sufficient structural integrity needed in a subsequent composite formation process.

The hardened preform is then used in the composite formation process to form a composite body, such as, a metal matrix composite article or a ceramic matrix composite article. It should be understood that while this disclosure refers primarily to forming metal matrix composite bodies by the pressureless metal infiltration process, the concept of this disclosure also applies to formation of metal matrix composite articles by, for example, pressure infiltration, vacuum-assisted infiltration, etc.

Moreover, it is possible to use the binders of the present invention in conjunction with traditional binders. For example, a preform could be formed by mixing together a first "traditional" binder material and at least one filler material. The binder/filler material could then be shaped into a preform. The preform could then be heated to "burn-out" the traditional binder (if such a heating step is required) and the preform could then be infiltrates with a binder of the present invention. Such infiltration could be accomplished by, for example, soaking the preform in a bath or pool of the organometallic, ceramic precursor binder of the instant invention. However, any suitable means for infiltrating the preform may be used (e.g., vacuum infiltration, pressure infiltration, etc.).

The following examples are provided to illustrate particular embodiments of the invention, but are not intended to be limitative thereof.

EXAMPLE 1

This Example demonstrates a method for fabricating a sand mold for metalcasting using a Polyureasilazane in accordance with the present invention.

An about 8.0 gram sample of a polyureasilazane prepared as described in U.S. Pat. No. 4,929,704, Example 4, was combined with about 5.0 percent by weight dicumyl peroxide. Washed silica sand (about 192 gram, Wedron Silica Co., Wedton, Ill.) was hand mixed into the polymer/peroxide blend to give a "wet" sand consistency with a polymer loading level of about 4 weight percent. An about 20 gram sample of the polymer/sand mixture was loaded into a conically shaped crucible and compacted. The crucible was heated to about 120° C. for a period of about 1 hour, the temperature was raised to about 130° C. and the crucible was held at this temperature for about 1 hour, and the temperature was then raised to about 140° C. for about 0.5 hour. The vessel was allowed to cool to room temperature. The polymer/sand mixture had hardened in the crucible, and replicated the exact shape of the crucible. The molded piece could be sanded to a new shape by rubbing with coarse silicon carbide abrasive cloth. The hardened 4 percent by weight part could be dropped or thrown against a table top without visible damage.

EXAMPLE 2

This Example demonstrates the use of differing binder amounts in a sand mold fabricated in accordance with the present invention.

In the same manner as Example 1, polymer sand mixtures were prepared at the 0.5 percent by weight and 1 percent by weight polymer levels. About 20 gram samples were loaded into crucibles and cured according to the heating schedule of Example 1. The following observations were noted. The cured 1.0 percent by weight part could be dropped or thrown onto the table top with only slight visible edge damage. The 0.5 percent by weight cured part could be crumbled by hand using considerable effort.

EXAMPLE 3

This Example demonstrates a method for fabricating a sand mold for metalcasting using a polysilazane in accordance with the present invention. Substantially the same procedure used in Example 1 was used to prepare a hardened part comprising 4 percent by weight poly(methylvinyl) silazane binder prepared by the ammonolysis of an 80:20 molar ratio mixture of methyldichlorosilane to vinylmethyldichlorosilane in hexane solvent according to procedures detailed in Example 1 of U.S. Pat. No. 4,929,704. The part could be dropped or thrown against a table top without visible damage.

EXAMPLE 4

This Example demonstrates a method for fabricating a sand mold for metal casting in accordance with the present invention.

Dicumyl peroxide (about 1.2 gram) was dissolved in the polyureasilazane polymer described in Example 1 (about 24 grams). Washed silica sand (about 1176 grams, Wedron Silica Co., Wedron, Ill.) was slowly mixed into the polymer/peroxide blend to form an about 2 percent by weight polymer/sand mixture. This 2 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

EXAMPLE 5

This Example demonstrates a method for fabricating a sand mold for metal casting and thereafter casting molten aluminum alloy into the cavity of the sand mold.

Dicumyl peroxide (about 0.6 gram) was dissolved in the polyureasilazane polymer described in Example 1 (about 12 grams). Washed silica sand (about 1176 grams, Wedron Silica Co., Wedron, Ill.) was slowly mixed into the polymer/peroxide blend to form a 1 percent by weight polymer/sand mixture. This 1 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

The cured mold was then placed on a table and an aluminum alloy comprising about 10% silicon by weight, balance aluminum, was melted and raised to a temperature of about 700° C. After stabilizing the temperature of the molten aluminum alloy at about 700° C., a ladle was dipped into the molten aluminum alloy and a small sample of the aluminum alloy was slowly poured into the cavity of the mold and the aluminum alloy was allowed to cool to room temperature.

FIG. 1 is a photograph of the cast aluminum alloy part and the mold.

EXAMPLE 6

This Example demonstrates a method for fabricating a sand mold for metal casting and thereafter casting molten aluminum alloy around the sand mold.

Dicumyl peroxide (about 1.2 gram) was dissolved in the polyureasilazane polymer described in Example 1 (about 24 grams). Washed silica sand (about 1176 grams, Wedron Silica Co., Wedron, Ill.) was slowly mixed into the polymer/peroxide blend to form a 2 percent by weight polymer/sand mixture. This 2 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

The cured sand mold was placed into a graphite mold having a cavity measuring about 7 inches by 7 inches by 1 inch. An aluminum alloy comprising about 10% by weight silicon, balance aluminum, was melted and maintained at a temperature of about 700° C. A ladle was dipped into the molten aluminum and a small sample of the aluminum alloy was poured into the graphite mold, around the cured sand mold, but not into its cavity, and allowed to cool to room temperature.

EXAMPLE 7

This Example demonstrates a method for fabricating a sand mold for metal casting and thereafter casting molten cast iron into the cavity of the sand mold.

Dicumyl peroxide (about 0.6 gram) was dissolved in the polyureasilazane polymer described in Example 1 (about 12 grams). Washed silica sand (about 1176 grams, Wedron Silica Co., Wedron, Ill.) was slowly mixed into the polymer/peroxide blend to form a 1 percent by weight polymer/sand mixture. This 1 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

Figure 2:
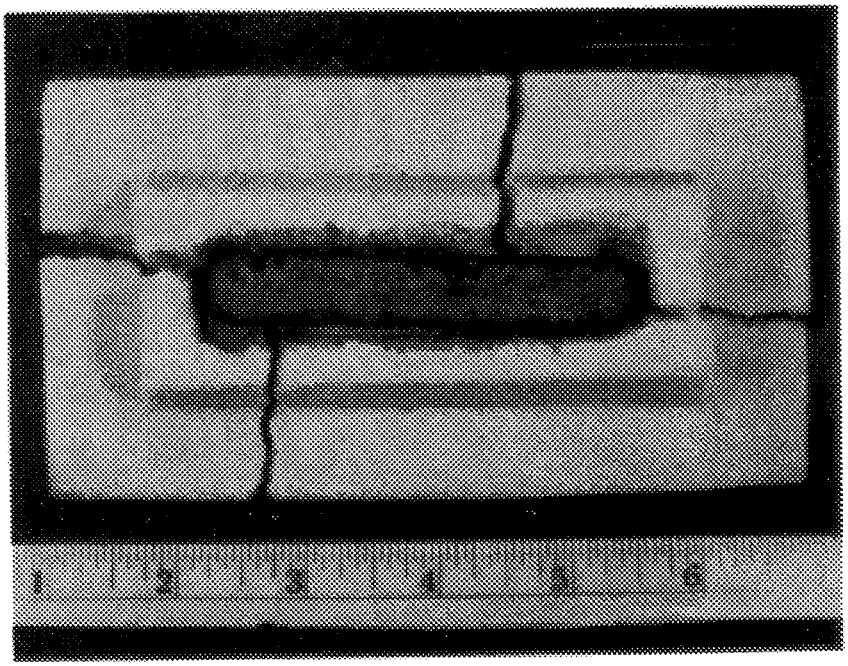
FIG. 2 is a photograph of the cast iron piece and the sand mold formed in Example 7.

A quantity of cast iron was placed into a small crucible and melted and maintained at a temperature of about 1350° C. After maintaining a temperature of about 1350° C., a small amount of the cast iron was poured from the crucible into the center cavity of the cured sand mold and allowed to cool to room temperature. FIG. 2 is a photograph of the cooled cast iron piece and the sand mold.

EXAMPLE 8

This Example demonstrates a method for fabricating a sand mold for metal casting and thereafter casting molten cast iron around the sand mold.

Dicumyl peroxide (about 1.2 grams) was dissolved in the polyureasilazane polymer described in Example 1 (about 24 grams). Washed silica sand (about 1176 grams, Wedton Silica Co., Wedron, Ill.) was slowly mixed into the polymer/peroxide blend to form a 2 percent by weight polymer/sand mixture. This 2 percent by weight binder/sand mixture was packed into a rubber mold containing a positive definition well for metal casting. The binder/sand mixture was cured in an air atmosphere oven at about 100° C. for a period of about 30 minutes, the temperature was raised to about 110° C. for about 1 hour, and then raised to about 125° C. for about 1 hour. The mold was cooled to room temperature and the sand was demolded. The sand replicated the shape of the mold.

The cured sand piece was placed into a steel frame having a cavity of about 6 inches by 5 inches. A quantity of cast iron was melted in a small crucible and maintained at a temperature of about 1350° C. The cast iron was then poured from the crucible into the steel frame and around the cured sand piece, but not into its cavity, and allowed to cool to room temperature.

EXAMPLE 9

The present Example demonstrates, among other things, a method for forming a metal matrix composite brake rotor or disc with a Maximum Operating Temperature (MOT) of at least about 482° C. (900° F.). The present Example presents the method for forming an aluminum oxide particulate reinforced aluminum metal matrix composite brake rotor or disc. The formation of the aluminum oxide particulate reinforced aluminum metal matrix composite (also designated "$Al_2O_{3p}$/Al MMC") rotor or disc includes, among other things, filler material preparation, preform formation, and spontaneous infiltration of the preform with a molten matrix metal. The present Example also presents the Maximum Operating Temperature (MOT) of the $Al_2O_{3p}$/Al MMC brake rotor or disc as determined by using the modified SAE J212 testing procedure.

A pressing mixture comprising by weight about 94.33 percent C-73 unground aluminum oxide (Alcan Chemicals, a division of Alcan Aluminum Corporation, Cleveland, Ohio and hereinafter "C-73 $Al_2O_{3p}$"), about 2.83 weight percent –325 mesh (particle diameter less than about 45 microns) ground magnesium powder (Hart Corporation, Tamaqua, Pa., and hereinafter "Mgp"), about 2.83 weight percent CERASET™ SN polyureasilazane pre-ceramic polymer or "ceramer" (Lanxide Corporation, Newark, Del.) and 0.01 percent DICUP®-R dicumyl peroxide (Hercules Incorporated, Wilmington, Del.) was prepared.

The preparation of a pressing mixture included the preparation of an C-73 $Al_2O_{3p}$-Mgp mixture. Specifically, about 6060 grams of a material mixture comprising by weight of about 39.53 percent C-73 $Al_2O_{3p}$ (Alcan Chemicals of Alcan Aluminum Corporation, Cleveland, Ohio), about 1.19 percent –325 mesh (particle diameter less than about 45 microns) Mgp (Hart Corporation, Tamaqua, Pa.) and about 59.29 percent ⅜ inch (9.5 mm) diameter by about ⅜ inch (9.5 mm) long alumina milling media were placed into an about 2-gallon (7.6 liter) capacity ceramic milling jar (Standard Ceramic Supply Co., Pittsburgh, Pa.). The ceramic milling jar and its contents were placed on a jar mill (ROMCO, Poughkeepsie, N.Y.) for about 2 hours. The ceramic jar was then removed from the jar mill and its contents were passed through a 20 mesh (average opening of about 850 microns) sieve to separate the alumina milling media from the C-73 $Al_2O_{3p}$-Mgp mixture. The C-73 $Al_2O_{3p}$-Mgp mixture was then set aside.

Simultaneously, a pre-ceramic polymer binder was prepared. Specifically, about 120 grams of a mixture comprised by weight of about 99.5 percent CERASET™ SN polyureasilazane pre-ceramic polymer (ceramer) and about 0.5 percent "DICUP®-R" dicumyl peroxide were combined in a "NALGENE®" 1-pint (0.47 liter) plastic jar. The sealed plastic jar and its contents were then placed on a jar mill and roll mixed for about 30 minutes, that is, until the dicumyl peroxide had substantially completely dissolved into the polyureasilazane pre-ceramic polymer. The contents of the plastic jar were then ready to be combined with the C-73 $Al_2O_{3p}$-Mgp mixture as a binder.

About 2060 grams of the C-73 $Al_2O_{3p}$-Mgp mixture were then placed into the mixing bowl of a Model RVO2 "EIRICH®" mixer (Eirich Machines, Maple, Ontario, Canada). The speed of the mixing paddles was then set at mixing speed setting 1, low. Simultaneously, the about 120 grams of the binder comprising the pre-ceramic polymer and the dicumyl peroxide were placed into a siphon cup of a Model 62 Binks spray gun (Binks Corporation, USA). As the C-73 $Al_2O_{3p}$-Mgp mixture was agitated in the mixing bowl, about 40 grams of the binder were sprayed onto the C-73 $Al_2O_{3p}$-Mgp mixture at a rate of about 13 grams per minute. The air pressure supply to the spray gun was at about 40 psi (276 kilopascal). After the binder had been sprayed onto the C-73 $Al_2O_{3p}$-Mgp mixture, the mixer was turned off. The sidewalls of the mixing bowl were then scraped so that the C-73 $Al_2O_{3p}$-Mgp-binder mixture was in the bottom of the mixing bowl. The mixing bowl was then covered, the mixer was set at speed setting 2, and mixing was performed for about 2 minutes. The C-73 $Al_2O_{3p}$-Mgp-binder mixture was then screened through a 20 mesh (average opening of about 850 microns) sieve which produced a pressing mixture. The pressing mixture was then placed into a sealable plastic bags (e.g., "ZIPLOC®" plastic bags) for storage until it could be used for preform formation.

A four-piece pressing mold with major components machined from Grade ATJ graphite (Union Carbide Corp., Cleveland, Ohio) was fabricated to form preforms from the pressing mixture. The pressing mold comprised a base plate, a mandrel, a mold wall, and a mandrel extension. The base plate, the mandrel and the mold wall were machined from Grade ATJ graphite; however, the mold mandrel extension was machined from commercially available aluminum.

The base plate had an outer diameter measuring about 13 inches (330 mm), an inner diameter of about 1.75 inches (44.5 mm) and a height of about 0.5 inch (13 mm). The base plate also had a lip measuring about 0.25 inch (6.4 mm) high and extending about 0.75 inch (19 mm) in from the 13 inch (330 mm) outer diameter toward the inner diameter. The machined surface finish of the base plate was about 63 rms.

The mandrel comprised a base plate engaging portion, a hub small diameter defining portion and a hub large diameter defining portion. The hub small diameter defining portion was located between the base plate engaging portion and the hub large diameter defining portion. The three portions also shared a common axis of rotational symmetry. The base plate engaging portion measured about 1.75 inches (44.5 mm) in diameter and was about 0.5 inch (13 mm) high. The hub small diameter defining portion measured about 2.125 inches (53.98 mm) in diameter and about 0.46 inch (11.7 mm) high. The hub large diameter defining portion had a diameter measuring about 4.32 inches (109.7 mm) at about 2.75 inches (70 mm) at the end of the mandrel farthest from the base engaging portion. The hub large diameter defining portion also had an about 5° draft extending from the 4.32 inches (109.7 mm) end toward the hub small diameter defining portion.

The mold wall comprised three defining diameters including an outer diameter, an intermediate diameter and an inner diameter. The outer diameter and the intermediate diameter defined a thin wall portion measuring about 4.25 inches (108 mm) high while the outer diameter and the inner diameter defined thick wall portion measuring about 1.25 inches (31.8 mm) high. The intermediate diameter mold wall measuring about 9.63 inches (245 mm) of was measured about 1.25 inches (31.8 mm) from the portion of the mold wall that engaged the base plate. An about 2° draft was machined on the inner diameter of the thick wall portion and the inner diameter of the thin wall portion of the mold wall.

The mold mandrel extension, as mentioned earlier, was machined from commercially available aluminum. The mold mandrel extension had a diameter measuring about 4.32 inches (109.7 mm) and a height of about 0.5 inch (13 mm). Machined in the center of the mold mandrel extension was an alignment pin measuring about 0.25 inches (6.4 mm) in diameter.

The base plate, mandrel, mold wall and mold mandrel extension were assembled in preparation for pressing a preform from the pressing mixture comprising the C-73 $Al_2O_{3p}$-Mgp-binder mixture.

In preparation for pressing a green preform, the pressing mold was lined with "PERMAFOIL™" graphite foil (TTAmerica, Portland, Oreg.) measuring about 0.010 inch (0.25 mm) thick. The graphite foil lining of the pressing mold facilitated the release of the preform formed from the pressing mold.

After the pressing mold had been lined with the graphite foil, some pressing mixture was placed into the lower portion of the pressing mold. The press mixture was gently handpacked around the hub smaller diameter defining portion of the mandrel. Additional pressing mixture was placed into the pressing mold. The additional pressing mixture was then first gently packed using a commercially available foam brush, then leveled and finally tamped using a tamping tool machined from aluminum. The pressing mixture was then leveled to coincide with the top surface of the mold mandrel extension. An annulus comprising "PERMAFOIL™" graphite foil (TTAmerica, Portland, Oreg.) was then placed onto the pressing mixture. A punch, also having an annulus shape, and machined from commercially available aluminum, was engaged with the annulus within the pressing mold. Four load transferring rods were then attached to the punch. The load transferring members were evenly spaced along the annulus of the punch. The pressing mold and its contents were then placed on a Carver 50-ton laboratory press (Fred S. Carver, Inc., Menomonee Falls, Wis.). A load was applied to the pressing mixture by engaging the platens of the laboratory press with the mold base and the four load transferring rods. The load was adjusted to produce a pressure of about 100 psi (689.5 kPa) on the pressing mixture and was maintained for about 30 seconds.

After the load was removed from the pressing mixture, the pressing mold and its contents were placed into an air atmosphere furnace to cure the pre-ceramic polymer binder within the pressing mixture. The curing was effected by heating the furnace and it contents at a rate of about 100° C. per hour to about 150° C., holding the furnace and its contents at about 150° C. for about 2 hours and cooling the furnace and its contents to about 85° C. at about 100° C. per hour. The pressing mold and its contents were then removed from the air atmosphere furnace. While still at about 85° C., the pressing mold was disassembled and the preform was removed. The shape of the preform corresponded to the shape of a brake rotor or disc. The preform was comprised of the C-73 $Al_2O_{3p}$-Mgp mixture bonded with cured pre-ceramic polymer. The preform was stored at about 85° C. prior to incorporation into a lay-up to form the C-73 $Al_2O_{3p}$/Al MMC brake rotor or disc.

The preform was infiltrated with an aluminum matrix metal using the "PRIMEX™" pressureless metal infiltration process to form a C-73 $Al_2O_{3p}$/Al MMC brake rotor or disc. A lay-up was prepared in order to infiltrate the preform with molten aluminum matrix metal. The lay-up comprised the preform, a catch tray, setup tray, setup tray lining, small preform support ring, large preform support ring, barrier powder, barrier mixture, barrier coating applied to the outer surfaces of the preform, cylinder, support boxes, matrix metal containment, sealing beads, matrix metal guide cone, shim, matrix metal supply tray, matrix metal supply tray lining and matrix metal ingots.

The inner dimensions of the catch tray measured about 21.25 inches (539.8 mm) long, 12.5 inches (317.5 mm) wide and about 2 inches (51 mm) high. The catch tray had walls of two thicknesses. The walls along the 21.25 inch (539.8 mm) sides measured about 0.25 inch (6.4 mm) thick, and the walls along the about 11.5 inch (305 mm) sides measured about ⅜ inch (9.5 mm).

The setup tray measured about 19.5 inches (495.3 mm) long, about 9.875 inches (250.8 mm) wide and about 2 inches (51 mm) deep. Unlike the catch tray, the setup tray had walls of a single thickness. The walls measured about 0.25 inch (6.4 mm) thick.

The setup tray lining within the setup tray comprised "GRAFOIL®" graphite foil (Union Carbide Corporation, Cleveland, Ohio) measuring about 0.015 inch (0.38 mm) thick. The setup tray lining substantially covered the inner surfaces of the setup tray.

The small preform support ring and the large preform support ring comprised "PERMAFOIL™" graphite foil (TTAmerica, Portland, Oreg.) measuring about 0.01 inch (0.25 mm) thick. Strips of graphite foil measuring about 0.25 inch (6.4 mm) high were cut and shaped into rings corresponding substantially to the inner and outer diameter of the hub portion of the preform. The small preform support ring and large preform support ring were placed concentrically within the setup tray and on the setup tray lining to support the preform during the pressureless metal infiltration process.

The graphite powder comprised "LONZA®" KS 44 graphite powder (Lonza, Inc., Fairlawn, N.J.).

The barrier coating was applied to the preform, as is discussed in more detail below, prior to incorporating the preform into the lay-up. The barrier coating comprised at least one of AERODAG®-G (Acheson Colloids, Port Huron, Mich.) and "DAG®". 154 colloidal graphite (Acheson Colloids, Port Huron, Mich.).

The barrier mixture comprised by weight about 95 percent 90 grit (average particle diameter of about 216 microns) "38 ALUNDUM®" alumina (Norton Co., Worcester, Mass.) and about 5 percent F-69 glass frit (Fusion Ceramics, Inc., Carollton, Ohio).

The containment cylinder was formed from a piece of "GRAFOIL®" graphite foil (Union Carbide Corporation, Cleveland, Ohio) measuring about 39.4 inches (1000 mm) long, 3.3 inches (80 mm) high and about 0.015 inch (0.38 mm) thick. The containment cylinder was placed concentrically around the preform. The graphite foil comprising the containment cylinder was secured around the preform using commercially available staples by stapling the graphite foil.

The support boxes comprised open ended boxes machined from commercially available graphite and measuring about 6 inches (152 mm) square by about 2.75 inches (69.9 mm) high.

The matrix metal containment wall comprised "PERMAFOIL™" graphite foil (TTAmerica, Portland, Oreg.) material formed into a ring measuring about 1 inch (25.4 mm) tall and placed concentrically with the containment cylinder to form a gap measuring about 0.25 inch (6.3 mm) wide along the outermost perimeter of the preform rotor.

The sealing beads comprised "DAG®" 154 colloidal graphite (Acheson Colloids, Port Huron, Mich.) applied at the outermost perimeter of the preform and along the intersection of the preform and containment cylinder. The barrier material mixture was then placed in the space between the matrix metal containment and containment cylinder.

The matrix metal guide cone comprised "PERMAFOIL™" graphite foil (TTAmerica, Portland, Oreg.). The matrix metal containment cone was fabricated to facilitate efficient use of molten matrix metal in contact with the preform during the pressureless metal infiltration process.

The shim was in engaging contact with the matrix metal guide cone and matrix metal supply tray and comprised "PERMAFOIL™" graphite foil (TTAmerica, Portland, Oreg.).

The inner dimension of the matrix metal supply tray measured about 13.25 inches (337 mm) long, about 8.5 inches (216 mm) wide and about 1.5 inches (38 mm) deep. As the catch tray and the setup tray, the matrix metal supply tray had walls with two thicknesses. The wall along the 13.25 inch (337 mm) sides measured 0.25 inch (6.3 mm) thick and the walls along the 8.5 inch (216 mm) sides were ⅜ inch (9.5 mm) thick. Within the bottom of the matrix metal supply tray were two holes each having about 1 inch (25.4 mm) diameter. The centers of these holes were located along the intersection of diagonals in each half of the matrix metal supply tray. The inner surface of the supply tray was lined with the matrix metal supply tray lining. The supply tray lining comprised "PERMAFOIL™" graphite foil (TTAmerica, Portland, Oreg.) having holes measuring about 1 inch (25.4 mm) diameter and coinciding with the holes within the matrix metal supply tray.

To prepare the preform for incorporation in the lay-up, all of the surfaces of the preform were substantially completely sprayed with a coating comprising "AERODAG®" G colloidal graphite (Acheson Colloids, Port Huron, Mich). Three applications of "DAG®" 154 colloidal graphite (Acheson Colloids, Port Huron, Mich.) were brushed to the surfaces of the preform which would face away from the matrix metal ingots when the preform was incorporated into the lay-up. The outer perimeter of the preform was also brush coated. Two applications comprising "DAG®" 154 colloidal graphite were brushed onto the surfaces of the preform facing the matrix metal ingots. A third application comprising "DAG®" 154 was brushed onto the surfaces having two applications. While the surfaces were still moist, −50 +100 mesh (having particle diameters between about 150 and 300 microns) magnesium powder was sprinkled onto the surface.

After the lay-up was formed, and comprising a preform weighing about 2000 grams and two matrix metal ingots together weighing about 3500 grams and comprising by weight about 1 weight percent magnesium and the balance aluminum, the lay-up and its contents were placed into a controlled atmosphere furnace. The furnace door was closed, and the furnace and its contents were evacuated to about 30 inches (762 mm) of mercury. The vacuum was ended when nitrogen gas flowing at about 10 liters per minute was introduced into the furnace. The furnace and its contents were then heated from about 150° C. to about 250° C. at about 100° C. per hour, held at about 250° C. for about an hour, heated from about 250° C. to about 450° C. at about 100° C. per hour, held at about 450° C. for about 5 hours, heated from about 450° C. to about 800° C. at about 100° C. per hour and held at about 800° C. for about 6 hours. Throughout the entire heating procedure, a nitrogen gas flow rate of about 10 liters per hour was maintained. After about 6 hours at about 800° C., the nitrogen gas flow rate was interrupted and the lay-up was removed from the furnace and transferred to a chill plate. The matrix metal supply tray was removed. A remaining molten matrix metal reservoir was then covered with an about 1 inch (25.4 mm) hot topping mixture comprising "FEEDOL" 9 exothermic hot topping compound (Foseco Corporation, Cleveland, Ohio). The matrix metal that had infiltrated the preform was then allowed to solidify during cooling to about room temperature. At about room temperature, the lay-up was disassembled further and it was revealed that the matrix metal had infiltrated the preform to form a near net shape C-73 $Al_2O_{3p}$/Al MMC composite rotor or disc.

The resulting metal matrix composite body was then machined to the specification of front brake rotors or discs compatible with the 1991 Model year Escort automobile (Ford Motor Co., Detroit, Mich.). The surfaces of the brake rotor or disc that would be in contact with braking pads were machined to a surface finish of 63 rms. The thickness of the braking disc measured about 0.8 inch (20 mm).

The brake rotor or disc was subjected to the modified SAE J212 brake system dynamometer test. The results of the test indicated that the C-73 $Al_2O_{3p}$/Al MMC brake rotor or disc made by the method of the present Example had an unexpected Maximum Operating Temperature (MOT) of about 532° C. (990° F.).

Thus, the present Example demonstrates that a C-73 $Al_2O_{3p}$/AI MMC brake rotor or disc (i.e., C-73 unground alumina embedded by an aluminum- magnesium matrix metal) possesses unexpectedly high temperature performance capability. Furthermore, these high temperature performance or operation capabilities indicate that the brake rotor or disc formed by the methods of the present Example are superior to the commercially available metal matrix composite brake rotors or discs. Additionally, these results indicate that brake rotors made by the methods of the present Example can be subjected to higher inertial loading than commercially available metal matrix composite brake rotors.

EXAMPLE 10

The present example demonstrates, among other things, the formation of a metal matrix composite piston pin. Specifically, the present Example demonstrates a method for forming a piston pin formed by the spontaneous infiltration of an alloy into a preform formed by a low pressure pressing technique which incorporates a metal-nitrogen polymer as a binder for silicon carbide particles.

A silicon carbide piston pin preform measuring approximately 100 mm in length was prepared comprising silicon carbide filler and a polyureasilazane binder mixture. A polyureasilazane binder mixture was prepared by mixing respectively, about 0.25% DBE (alliphatic dibasic ester, DuPont Co., Wilmington, Del.), by weight of the silicon carbide, about 0.5% "Dicup®-R" dicumyl peroxide (Hercules, Inc., Wilmington, Del.) and about 0.1% "Lupersol®" 256 (ELF Atochem, Philadelphia, Pa.) both by weight of the polyureasilazane, and about 2% polyureasilazane (prepared substantially according to Examples 1 and 2 of U.S. Pat. No. 4,929,704) based on the weight of the silicon carbide. Approximately 5,000 gram batches of silicon carbide (500 round grain silicon carbide, Norton Company, Worcester, Mass.) were mixed with the binder system in the following manner. The silicon carbide and about half of the binder mixture was placed in a mixing bowl and mixed on an "Eirich®" mixer (Eirich Machines, Maple, Ontario, Canada) on a high speed setting for about 3 minutes, at which time the bowl and rotors were scraped. The second half of the binder system was added to the bowl and mixed for about 3 additional minutes, at which time the bowl and rotors were scraped again, and the filler/binder mixture was further mixed for about 2 minutes on the high speed setting. After mixing, the filler/binder mixture was used immediately or stored in the freezer for up to about 24 hours.

Piston pin dies and top and bottom punch faces were sprayed with "PARFILM®" (polyester parfilm, Price-Driscoll Corp., Farmingdale, N.Y.) and preheated to about 80° C. The punch was placed in the bottom of a die so that only about ¼" of the punch was in the die cavity. The die was charged with the filler/binder mixture, and the top punch was placed on the die. The assembly was placed on a platen which was heated to about 200° C., and the center of the die was wrapped with a heating tape. The assembly was pressed at about 1000 lbs of pressure and released, then pressed to about 200 psi for about 40 minutes. The preform was removed from the mold while hot and placed in an oven at about 80° C.

An internal cavity was machined into the preform, and the final dimensions of the machined preform was approximately 60 mm o.d.×40 mm i.d.×98 mm length. After machining, the preform was prefired in a furnace which was heated at about 100°/hour to about 850° and held for about 4 hours. The furnace was cooled at about 100°/hour to about 80° C. before removing the preform.

The preforms, formed by the above process, were prepared for spontaneous infiltration by first heating in an air oven at about 80° C. for about 20 minutes, coating all of the surfaces of the heated preforms with a coating solution comprising a DBE/20% "Q-PAC®" solution (DBE-alliphatic dibasic ester, DuPont Co., Wilmington, Del.; "Q-PAC®" -PAC Polymers, Greenville, Del.) and then subsequently heating the coated preforms at about 80° C. for approximately 10 minutes. A coating of "DAG®" 154 colloidal graphite (Acheson Colloids Co., Port Huron, Mich.) was applied to the internal and external surfaces of the preform. Subsequently, a barrier solution comprising about 50:50 "DAG®" 154/"Dylon®" CW (Dylon Industries, Cleveland, Ohio) solution was applied to the outside surfaces of the preform, and a coating solution of 50% by weight magnesium/50% by weight "DAG®" 154 (a 50% by volume "DAG®" 154/50% volume ethanol solution) was applied to the internal diameter surface of the preform In preparing an infiltration set-up, the preform was glued with "RIGIDLOCK®" graphite cement (Polycarbon Corp., Valencia, Calif.) to a sheet of "GRAFOIL®" graphite foil (Union Carbide, Cleveland, Ohio) and placed in a graphite boat assembly. A graphite feed boat was fit with a sheet of "GRAFOIL®" graphite foil and feed holes were formed, and glued to the top of the preforms. An aluminum alloy comprising by weight 10% Si, 4% Mg, balance aluminum was placed inside the feed boat, and the feed boat was covered with "GRAFOIL®" graphite foil. The preform and alloy assembly was placed in a nitrogen atmosphere in a retort furnace, a nitrogen gas flow rate of about 10 liters per minute was established, and the furnace was heated at 200° C./hour to 450° C., and held at 450° C. for 5 hours, then heated at 100° C./hour to 525° C., and held at 525° C. for 3 hours, then heated at 100° C./hour to 825° C. for 15–18 hours until infiltration was complete.

EXAMPLE 11

The present example demonstrates, among other things, the formation of metal matrix composite plates. Specifically, the present example demonstrates the formation of a metal matrix composite by the spontaneous infiltration of a preform formed by a low pressure pressing technique which incorporates a metal-nitrogen polymer as a binder.

Flat plate preforms approximately 15.2 cm×15.2 cm×2.5 cm and 12.7 cm×17.8 cm×1 cm (6"×6"×0.8" and approximately 5"×7"×0.8") were prepared comprising silicon carbide filler (500 round grain silicon carbide, Norton Company, Worcester, Mass.) and a polyureasilazane binder mixture. A polyureasilazane binder mixture was prepared by mixing respectively, about 0.1% DBE (alliphatic dibasic ester, DuPont Co., Wilmington, Del.), by weight of the silicon carbide, about 1% "DiCup®-R" dicumyl peroxide (Hercules, Inc., Wilmington, Del.) and about 0.1% "Lupersol®" 256 (ELF, Atochem, Philadelphia, Pa.) both by weight of the polyureasilazane, and about 2.5% polyureasilazane (prepared substantially according to Examples 1 and 2 of U.S. Pat. No. 4,929,704), based on the weight of the silicon carbide. Approximately 5,000 gram batches of silicon carbide were mixed with the binder system in the following manner. The silicon carbide and half of the binder mixture was placed in a mixing bowl and mixed on an "Eirich®" mixer (Eirich Machines, Maple, Ontario, Canada) on a high speed setting for about 3 minutes, at which time the bowl and rotors were scraped. The second half of the binder system was added to the bowl and mixed for about 3 additional minutes, at which time the bowl and rotors were scraped again, and the filler/binder mixture was further mixed for about 2 minutes on the high speed setting. After mixing, the filler/binder mixture was used intermediately or stored in the freezer for up to about 24 hours.

Flat plate dies, lined with "PERMAFOIL™" graphite foil (TTAmerica, Portland, Oreg.), were preheated to about 80° C. and charged with the filler/binder mixture. The assembly was placed on a platen heated to about 200° C., and then pressed to about 200 psi for about 20 minutes. The preforms were removed from the mold while hot and placed in an oven at about 80° C. The preforms were prefired in a furnace which was heated at about 100° C./hour to about 850° C. and held for about 4 hours. The furnace was cooled at about 100° C./hour to about room temperature before removing the preforms.

Preforms were prepared for spontaneous infiltration by first heating the preforms in an air atmosphere oven at about 80° C. for about 20 minutes, coating the heated preforms with a coating mixture comprising a DBE/20% "Q-PAC®" solution (DBE-alliphatic dibasic ester, DuPont Co., Wilmington, Del.; "Q-PAC®"-PAC Polymers, Greenville, Del.) and then heating at about 80° C. for approximately 10 minutes. A coating of "DAG®" 154 (colloidal graphite solution) was applied to the surfaces of the preform. Subsequently, a barrier solution comprising 50% "DAG®"/50% "Dylon®"CW (Dylon Industries, Cleveland, Ohio) was applied to five surfaces of the preform, and a solution of 50% magnesium/50% "DAG®" 154 (50% "DAG®"-comprising a 50% "DAG®"/50% ethanol solution) was applied to the internal surface of the preform.

The preforms were infiltrated with an aluminum alloy comprising by weight 10% Si, 4% Mg, balance aluminum. The preforms were placed in a graphite box lined with "GRAFOIL®" graphite foil (Union Carbide), and covered with an initiator comprising an admixture of 5% magnesium (−50 +100) and 95% 90 grit silicon carbide; the alloy was then placed on the preforms covered with the initiator. The preform and alloy assembly was placed in a nitrogen atmosphere in a retort furnace, and was heated at about 200° C./hour to about 450° C., and held at about 450° C. for about 5 hours. The furnace was then heated at about 100° C./hour to about 525° C., and held at about 525° C. for about 3 hours. The temperature was again increased and the furnace was heated at about 100° C./hour to about 825° C. for about 15–18 hours until infiltration was complete. The furnace was cooled at about 200° C./hour to about 700° C., and the metal matrix composites were removed from the furnace.

EXAMPLE 12

The present example demonstrates, among other things, the formation of a metal matrix composite blocks. Specifically, the present Example demonstrates a method for forming metal matrix composite bodies formed by the spontaneous infiltration of a preform formed by a low pressure pressing technique which incorporates a metal-nitrogen polymer as a binder for a silicon carbide filler with magnesium incorporated into the filler material.

Silicon carbide preforms measuring approximately 15.2 cm×15.2 cm×2.5 cm (6"×6"×0.8") were prepared comprising silicon carbide filler admixed with magnesium and a polyureasilazane binder mixture. The filler mixture was prepared by blending 45% of #54 SiC, 15% #90 SiC, 15% #180 SiC, and 25% #500 SiC (all sizes of SiC-39 Crystolon® SiC, Norton Company, Worcester, Mass.) with 3% −100, +200 magnesium (Hart Corp., Tamaqua, Pa.) by weight of the SiC. A polyureasilazane binder mixture was prepared by mixing respectively, about 0.1% DBE (alliphatic dibasic ester, DuPont Co., Wilmington, Del.), by weight of the silicon carbide, about 1% "DiCup®-R" dicumyl peroxide (Hercules Inc., Wilmington, Del.) and about 0.1% "Lupersol®" 256 (ELF Atochem, Philadelphia, Pa.) both by weight of the polyureasilazane and about 2% polyureasilazane (prepared substantially according to Examples 1 and 2 of U.S. Pat. No. 4,929,704), based on the weight of the silicon carbide. Approximately 2,000 gram batches of silicon carbide admixed with magnesium powder were mixed with the binder system in the following manner. The silicon carbide/magnesium and about half of the binder mixture were placed in a mixing bowl and mixed on an "Hobart®" mixer at a high speed setting for about 1 minute; the bowl and mixing blades were scraped. The second half of the binder system was added to the bowl and mixed at a high speed setting for about 1 minute, the bowl and rotors were scraped again, and the filler/binder mixture was further mixed for about 1 minute at the high speed setting. After mixing, the filler/binder mixture was used immediately or stored in plastic bags for up to about 24 hours.

A die was lined with "PERMAFOIL®" graphite foil (TTAmerica, Portland, Oreg.) and preheated to about 80° C. Approximately 1000 grams of the filler/binder mixture was added to the die cavity and a top punch was placed in the die. The die/punch assembly was placed on a platen heated to about 200° C. The assembly was pressed to about 400 psi for about 20 minutes; the preform was removed from the die assembly and allowed to cool. The preform was air baked on a perforated refractory setter plate in a furnace heated at 100° C./hour to 425° C. and held for 4 hours, then cooled at 200° C./hour to 80° C.

Preforms, prepared by the above process, were prepared for infiltration by heating the preforms in an air atmosphere oven at about 80° C. for about 20 minutes, coating the heated preforms with a coating solution comprising DBE/25% "Q-PAC®" (DBE-alliphatic dibasic ester, DuPont Co., Wilmington, Del. "Q-PAC®"-PAC Polymers, Greenville, Del.) and then heating the coated preform at about 80° C. for approximately 10 minutes. One side of a heated preform was further coated with two thin coatings of "DAG®" 154 colloidal graphite (Acheson Colloids Co., Port Huron, Mich.); the other five sides of a heated preform were coated with a barrier solution comprising 50:50 "DAG®" 154/"Dylon®" CW (Dylon CW, Dylon Industries, Inc., Cleveland, Ohio). The coated preform was heated at about 80° C. for about 1 hour.

The preforms were infiltrated with an aluminum alloy comprising 10% silicon, 1% magnesium, and the balance of aluminum. The coated preforms were placed in a graphite boat lined with "PERMAFOIL®" graphite foil, and were surrounded with a mixture of 90 grit 38 "ALUNDUM® aluminuma" (Norton Company, Worcester, Mass.) and 1% F-69 glass frit (Fusion Ceramics, Inc., Carlton, Ohio). An initiator comprised of an admixture of 5% magnesium (−50, +100) and 95% silicon carbide was placed on the preforms and the aluminum alloy ingot was placed on the initiator. The preform and alloy assembly was heated in a nitrogen atmosphere in a retort furnace, and was heated at about 200° C./hour to about 450° C., and held at about 450° C. for about 5 hours. The furnace was then heated at about 100° C./hour to about 525° C., and held at about 525° C. for about 3 hours. The temperature was further increased and the furnace was heated at about 100° C./hour to about 800° C. for about 5 hours until infiltration was complete. The furnace was cooled at about 200° C./hour to about 700° C., and the metal matrix composites were removed from the furnace.

EXAMPLE 13

The present example demonstrates, among other things, the formation of a ceramic matrix composite valve seat. Specifically, the present Example presents a method for forming ceramic matrix composite bodies formed by the directed metal oxidation into a preform formed by a low pressure pressing technique which incorporates a metal-nitrogen polymer as a binder for a silicon carbide filler.

Silicon carbide preforms measuring approximately 12.8 cm×17.8 cm×1 cm (5"×7"×⅜") were prepared comprising silicon carbide filler and a polyureasilazane binder mixture. Approximately 2000 grams of filler, 1000 grit silicon carbide (Norton Company, Worcester, Mass.) was combined with a polyureasilazane binder mixture which was prepared by mixing respectively, about 10 grams DBE (alliphatic dibasic ester, DuPont Co., Wilmington, Del.), about 0.6 grams "DiCup®R" dicumyl peroxide (Hercules Inc., Wilmington, Del.), about 0.06 grams "Lupersol®" 256 (ELF Atochem, Philadelphia, Pa.) by volumetric measure, and about 60 grams polyureasilazane (prepared substantially according to Examples 1 and 2 of U.S. Pat. No. 4,929,704). The silicon carbide and about half of the binder system were placed in a mixing bowl and mixed on an "Hobart®" mixer at a high speed setting for about 3 minutes; the bowl and mixing blades were scraped. The second half of the binder system was added to the bowl and mixed at a high speed setting for about 3 minutes, the bowl and rotors were scraped again, and the filler/binder mixture was further mixed for about 4 minutes at the high speed setting, scraping the bowl and rotor once during this time. After mixing, the filler/binder mixture was used immediately or stored in plastic bags for up to about 24 hours.

A die was lined with "PERMAFOIL®" graphite foil (TTAmerica, Portland, Oreg.) and preheated to about 80° C. Approximately 480 grams of the filler/binder mixture was added to the die cavity and a top punch was slid into the die. The die/punch assembly was placed on a platen heated to about 200° C. The assembly was pressed to about 250 psi for about 20 minutes; the die was removed from the press assembly and allowed to cool. The preform was removed from the die and placed at about 150° C. in a drying oven for about 15 hours.

The preform was cut into several sections with each section machined to a valve seat preform approximately comprising the dimensions of about a 49.4 mm top and bottom o.d, about a 44.0 mm top i.d. and about a 39.5 mm bottom i.d forming a 45° seat angle, and a 7.4 mm height. The machined preforms were then prefired by heating in air at a rate of about 100° C./hour to about 1050° C., holding for 25 hours, and then cooled by decreasing the temperature at a rate of 200° C./hour.

The preforms were prepared for directed metal oxidation by coating the outer surfaces with a barrier mixture of $CaAl_2O_4$/"YK®" thinner ("YK®" thinner-ZYP Coatings, Oak Ridge, Tenn.); the bottom preform surfaces remained uncoated. A matrix growth assembly was prepared comprising an aluminum alloy comprising about 15–16.5 wgt % Si, 3–3.8 wgt % Cu, 2.7–3.3 wgt % Zn, 0.20–0.30 wgt % Mg, 0.7–1.0 wgt % Fe, ≦0.5 wgt % Ni, ≦0.5 wgt % Mn, ≦0.35 wgt % Sn, and the balance aluminum, which was placed in a refractory crucible containing coarse woolastonite surrounding the bottom and sides of the alloy. The assembly was heated to about 750° C. at about 200° /hour, at which temperature the surface of the molten alloy was scraped and the uncoated side of preforms were rested on the scraped surface of the molten alloy, and covered with about ⅛" of coarse woolastonite. The assembly was heated to about 900° C. at about 200° C./hour, and maintained until matrix growth was complete. The furnace was cooled to about 750° C. at about 200° C./hour and the composites were removed.

Subsequent to directed metal oxidation, the composites were additionally treated to remove residual aluminum metal. A graphite reinforced silicon carbide crucible was placed in a catch boat and surrounded by coarse woolastonite and placed inside a resistance heated air atmosphere elevator furnace with a suspended clamping device; the furnace was then heated to about 1130° C. A nickle alloy, comprising by weight about 40 wgt % Si, 5.9 wgt % Cu, 0.11 wgt % Fe, balance nickle was poured into the crucible. About six to eight valve seat composites were placed onto an aluminum rod supported by a refractory disc and affixed to the suspended clamping device. The furnace was raised until the valve seats were positioned at the 900° C. zone of the furnace and held for 5 minutes; the furnace was raised again until the valve seats were immersed in molten alloy. The composite valve seats were treated for 48 hours, removed, and sand blasted.

We claim:

1. A process for fabricating a porous preform for use in composite formation process comprising:

providing a hardenable, liquid, organometallic, ceramic precursor binder;

providing a mass of at least one filler material;

mixing together said hardenable, liquid, organometallic, ceramic precursor binder and said mass of at least one filler material to form at least one porous preform; and filling at least a portion of said porous preform with at least one metal by at least one process selected from the group consisting of spontaneous infiltration, pressure infiltration and vacuum assisted infiltration.

2. The process of claim 1, wherein said hardenable, liquid, organometallic, ceramic precursor comprises titanium, zirconium, aluminum, or silicon.

3. The process of claim 2, wherein said hardenable, liquid, organometallic, ceramic precursor comprises silicon.

4. The process of claim 1, wherein said hardenable, liquid, organometallic, ceramic precursor comprises oxygen or nitrogen.

5. The process of claim 4, wherein said hardenable, liquid, organometallic, ceramic precursor comprises nitrogen.

6. The process of claim 1, wherein said hardenable, liquid, organometallic, ceramic precursor comprises an alkenyl, alkynyl, epoxy, acrylate or methacrylate group.

7. The process of claim 6, wherein said hardenable, liquid, organometallic, ceramic precursor comprises an alkenyl group.

8. The process of claim 7, wherein said alkenyl group comprises a vinyl group.

9. The process of claim 3, wherein said hardenable, liquid, organometallic, ceramic precursor comprises a polyureasilazane.

10. The process of claim 3, wherein said hardenable, liquid, organometallic, ceramic precursor comprises a polysilazane.

11. The process of claim 3, wherein said hardenable, liquid, organometallic, ceramic precursor comprises a polysiloxane.

12. The process of claim 1, wherein said binder is present to the extent of 0.1% to about 20% based on the total weight of the filler material/binder mixture.

13. The process of claim 12 wherein said binder is present to the extent of 0.1 wt % to 5 wt % based on the total weight of the filler material/binder mixture.

14. The process of claim 13 wherein said binder is present to the extent of 0.1 wt % to 2 wt % based on the total weight of the filler material/binder mixture.

15. The process of claim 1, wherein the binder is hardened through the application of heat, UV irradiation, or laser energy.

16. The process of claim 15, wherein the binder is hardened through the application of heat.

17. The process of claim 16, where the binder further comprises a free radical generator.

18. The process of claim 17, wherein said free radical generator is a peroxide or an azo compound.

19. The process of claim 18, wherein said peroxide is dicumyl peroxide.

20. The process of claim 1, wherein said at least one metal comprises aluminum.

21. The process of claim 1, wherein at least a portion of said porous preform is filled by a spontaneous infiltration process.

22. The process of claim 21, wherein at least one of an infiltration enhancer and an infiltration enhancer precursor are provided to said at least one preform.

23. The process of claim 21, wherein an infiltrating atmosphere is provided for at least a portion of the spontaneous infiltration process.

24. The process of claim 23, wherein said infiltrating atmosphere comprises a non-nitrogen atmosphere.

25. The process of claim 1, wherein said hardenable, liquid, organometallic, ceramic precursor binder comprises metal-nitrogen bonds.

26. The process of claim 25, wherein said hardenable, liquid, organometallic, ceramic precursor binder comprises at least one of silicon-nitrogen bonds, aluminum-nitrogen bonds and boron-nitrogen bonds.

27. The process of claim 1, wherein said porous preform has a porosity of between about 5% and 90% by volume.

28. The process of claim 26, wherein said porous preform has a porosity of between about 25% and 50% by volume.

29. The process of claim 21, wherein said at least one metal comprises aluminum.

30. The process of claim 22, wherein said at least one infiltration enhancer precursor comprises magnesium and said at least one metal comprises aluminum.

31. The process of claim 30, wherein an infiltrating atmosphere is provided for at least a portion of the spontaneous infiltration process.

32. The process of claim 31, wherein said hardenable, liquid, organometallic, ceramic precursor binder comprises metal-nitrogen bonds and said infiltrating atmosphere comprises a non-nitrogen atmosphere.

* * * * *